US009540170B2

(12) United States Patent
Morris, III et al.

(10) Patent No.: US 9,540,170 B2
(45) Date of Patent: Jan. 10, 2017

(54) ELECTROSTATIC CHARGE DISSIPATOR FOR STORAGE TANKS

(71) Applicants: Robert Franklin Morris, III, Covington, LA (US); Benjamin Allen Hearst, New Orleans, LA (US); Dan Steinberg, Blacksburg, VA (US)

(72) Inventors: Robert Franklin Morris, III, Covington, LA (US); Benjamin Allen Hearst, New Orleans, LA (US); Dan Steinberg, Blacksburg, VA (US)

( * ) Notice: Subject to any disclaimer, the term of this patent is extended or adjusted under 35 U.S.C. 154(b) by 413 days.

(21) Appl. No.: 14/191,359

(22) Filed: Feb. 26, 2014

(65) Prior Publication Data

US 2015/0239661 A1 Aug. 27, 2015
US 2015/0353278 A9 Dec. 10, 2015

Related U.S. Application Data

(60) Provisional application No. 61/851,028, filed on Feb. 28, 2013.

(51) Int. Cl.
*B65D 90/46* (2006.01)
*H05F 3/00* (2006.01)

(52) U.S. Cl.
CPC ..... *B65D 90/46* (2013.01); *H05F 3/00* (2013.01)

(58) Field of Classification Search
CPC ..... B65D 90/46; H05F 3/00
See application file for complete search history.

(56) References Cited

U.S. PATENT DOCUMENTS 3,730,193 A * 5/1973 Armistead ..... B65D 90/46 134/10
3,942,674 A * 3/1976 Nelson ..... B65D 88/42 174/2
4,352,143 A * 9/1982 Uno ..... H05F 3/02 15/1.51
4,404,171 A * 9/1983 Satoh ..... H05F 3/02 252/511
4,431,316 A * 2/1984 Massey ..... B32B 27/12 139/425 R
4,613,922 A * 9/1986 Bachmann ..... H05F 3/02 361/215
5,123,559 A * 6/1992 Qiu ..... B65D 90/46 220/216
5,387,455 A * 2/1995 Horsch ..... E04C 2/16 139/384 R (Continued)

*Primary Examiner* — Stephen W Jackson
*Assistant Examiner* — Christopher Clark

(57) ABSTRACT

Provided is an electrostatic charge dissipator for removing electrostatic charge inside a storage tank or other enclosed volume. The dissipator comprises yarns of electrically conductive polymeric fibers, such as carbon fiber. The yarns have broken fiber tips or stray fibers projecting away from the yarns, thereby functioning to concentrate electric fields and facilitate charge collection. The yarns are attached to a bracket for mechanical attachment to the tank, and are electrically connected to a feedthrough for providing an electrical path to ground potential. The present dissipator can also comprise a support, such as a rope, chain, or the like, and a weight for limiting the movement of the dissipator. The present dissipator is highly corrosion resistant and does not threaten pumps or valves with damaging metal debris.

54 Claims, 12 Drawing Sheets

(56) References Cited

U.S. PATENT DOCUMENTS

| | | | | | |
|---|---|---|---|---|---|
| 5,855,036 | A * | 1/1999 | Krock | A47L 9/02 | 15/339 |
| 6,158,537 | A * | 12/2000 | Nonobe | B60L 11/1851 | 180/65.1 |
| 6,315,004 | B1 * | 11/2001 | Wellman | F16L 9/14 | 138/129 |
| 6,561,229 | B2 * | 5/2003 | Wellman | F16L 9/14 | 138/132 |
| 7,136,271 | B2 * | 11/2006 | Oh | H05F 3/02 | 361/220 |
| 7,159,718 | B2 * | 1/2007 | Cassina | B65D 65/42 | 206/386 |
| 7,193,834 | B2 * | 3/2007 | Oh | H01R 13/6485 | 361/212 |
| 7,976,616 | B2 * | 7/2011 | Alam | B03C 3/41 | 313/351 |
| 2004/0045379 | A1 * | 3/2004 | Silverman | F16L 11/22 | 73/865.8 |
| 2004/0212945 | A1 * | 10/2004 | Sprenger | B01D 29/15 | 361/212 |
| 2009/0073629 | A1 * | 3/2009 | Forgue | B01D 35/26 | 361/215 |
| 2012/0227588 | A1 * | 9/2012 | Alam | B03C 3/41 | 96/89 |
| 2013/0176656 | A1 * | 7/2013 | Kaisser | B65D 90/46 | 361/215 |
| 2015/0239661 | A1 * | 8/2015 | Morris, III | H05F 3/00 | 361/215 |
| 2015/0245454 | A1 * | 8/2015 | Steinberg | H05F 3/00 | 361/215 |
| 2015/0284141 | A1 * | 10/2015 | Ni | B32B 15/08 | 428/34.3 |

* cited by examiner

ELECTROSTATIC CHARGE DISSIPATOR FOR STORAGE TANKS

RELATED APPLICATIONS

The present application claims the benefit of priority of provisional patent application 61/851,028, filed on Feb. 28, 2013, which is hereby incorporated by reference.

FIELD OF THE INVENTION

The present invention relates generally to explosion prevention and electrostatic charge dissipation. More particularly, the present invention relates to a device for dissipating electrostatic charge from inside a liquid storage tank or other container or structure.

BACKGROUND OF THE INVENTION

Liquid storage tanks are commonly used in petroleum production and at industrial facilities. These tanks are used to store petroleum products, contaminated wastewater, or process chemicals. These materials may contain flammable, volatile components that present an explosion hazard. If a tank contains flammable vapors and air, any source of electrostatic discharge can trigger a dangerous and costly explosion.

Consequently, electrostatic drain devices are sometimes employed inside storage tanks. The electrostatic drain device safely discharges electrostatic charges in the contained air and liquid to ground potential, thereby eliminating the possibility of an electrostatic explosion trigger.

FIG. 1 shows a conventional electrostatic drain and storage tank according to the prior art. The tank 10 contains a liquid and a mixture of air and explosive vapors. The explosive vapors may comprise low molecular weight hydrocarbon vapors such as butane for example. The liquid flows into and out of the tank 10 via a pipe connection 11. As the liquid moves through the pipe, electrostatic charge is created in the liquid via well known triboelectric effects. This electrostatic charge will become trapped in the tank if there is no conductive path to ground potential. The trapped electrostatic charge can trigger an explosion of the air and flammable vapor mixture.

Nonconductive tanks (e.g. made of polymers or fiberglass) are particularly problematic because they do not provide an electrically conductive path to ground potential. Metal tanks can also present a hazard if they are coated with an electrically insulating coating of epoxy or paint.

The prior art solution to this problem is to use a metal twisted wire brush 12 as an electrostatic drain. The metal wire brush device 12 is suspended inside the tank 10 and electrically connected to ground potential 13. The wire brush comprises a twisted cable 14 with embedded small diameter wires 15 (e.g. 0.001-0.020" diameter). The small diameter wires have sharp tips that serve to concentrate an electric field, and thereby facilitate charge collection. The wire brush 12 is typically made entirely of stainless steel. In operation, the drain device accumulates electrostatic charge present in the liquid and air, and provides a path for this charge to flow to ground potential 13.

The conventional solution of FIG. 1 is effective for dissipating electrostatic charge. However it has several serious disadvantages, including high cost, susceptibility to corrosion, difficulty of installation (since the central twisted wire is rigid or semi-rigid), and tendency of the small wires to loosen and fall off over time. The small wires can loosen because they are held at only a single point where they pass through the twisted cable. Hence if corrosion causes one wire to dislodge, then all other wires in the same bundle will fall out as well. Small wires or corroded metal particles that fall into the liquid will damage downstream equipment Consequently, the wire brush 12 presents a significant hazard for liquid-handling equipment such as filters, valves and pumps.

Corrosion is a great concern at petroleum facilities because the liquids in the tank often contain combinations of salts, acids, hydrogen sulphide and other substances that corrode many types of metals, including stainless steel. This is one reason why non-metallic tanks are preferred for these applications.

There is an urgent need for a low-cost, reliable, corrosion-proof and easily installed electrostatic charge dissipator that does not present a hazard to liquid handling equipment. Such a charge dissipator could greatly improve safety for workers and decrease the cost of oil and chemical production.

SUMMARY

Provided is an electrostatic charge dissipator for collecting and removing electrostatic charge inside a tank having a bracket, an electrical feedthrough, and a conductive polymeric fiber yarn. The bracket is for mounting to the tank, preferably on an inside surface. The electrical feedthrough extends through a wall of the tank (e.g. through the ceiling or a sidewall). The feedthrough provides an electrical conduction path through the tank wall. The conductive fiber yarn is electrically connected to the feedthrough and mechanically attached to the bracket. The conductive fiber yarn hangs from the bracket. The fibers of the yarn are exposed (i.e. not covered with electrically insulating material) in at least some locations, and the yarn has at least about 10, 100, 500 or 1000 broken fiber tips or stray fibers per foot of the dissipator. The broken fiber tips or stray fibers are at least about 0.020" or 0.050" or 0.10" long.

The conductive fibers can comprise carbon fiber, or other types of conductive polymeric material, such as polymers containing embedded conductive particles, carbon or nanowires.

The electrical feedthrough can comprise a bolt extending through the tank wall. The bolt can be part of the bracket, or used to attach the bracket to the tank.

The dissipator can further comprise a support with a first end attached to the bracket and a second hanging end. The support reduces swinging of the dissipator and reduces mechanical strain applied to the fiber yarn. The support can comprise rope, chain, cable, wire or the like.

A weight can be attached to the hanging end of the support.

The conductive fiber yarns can be in the form of a braided sleeve. The braided sleeve can surround the support (i.e. the support can be disposed inside the braided sleeve).

The dissipator can be attached to a bottom of the tank. The dissipator can be attached to the bottom by a hook/latch mechanism, bolts, or by bonding (e.g. with adhesive or resin). The support and/or conductive fiber yarn can be attached to the tank bottom.

The conductive fiber yarn can be wrapped around or threaded through the support.

The bracket can comprise a feedthrough bolt attached to a vertical plate, with the conductive fiber yarns clamped against the vertical plate.

The present invention also includes a storage tank in combination with the electrostatic charge dissipator. The tank has a ceiling and sidewalls, and an interior volume. The dissipator is attached to the tank, and is disposed inside the interior volume. The dissipator is attached to the tank with a bracket, and an electrical feedthrough provides an electrical conduction path through the tank wall. The support and/or the conductive fiber yarn can be attached to the tank bottom.

DETAILED DESCRIPTION

Figure 1:
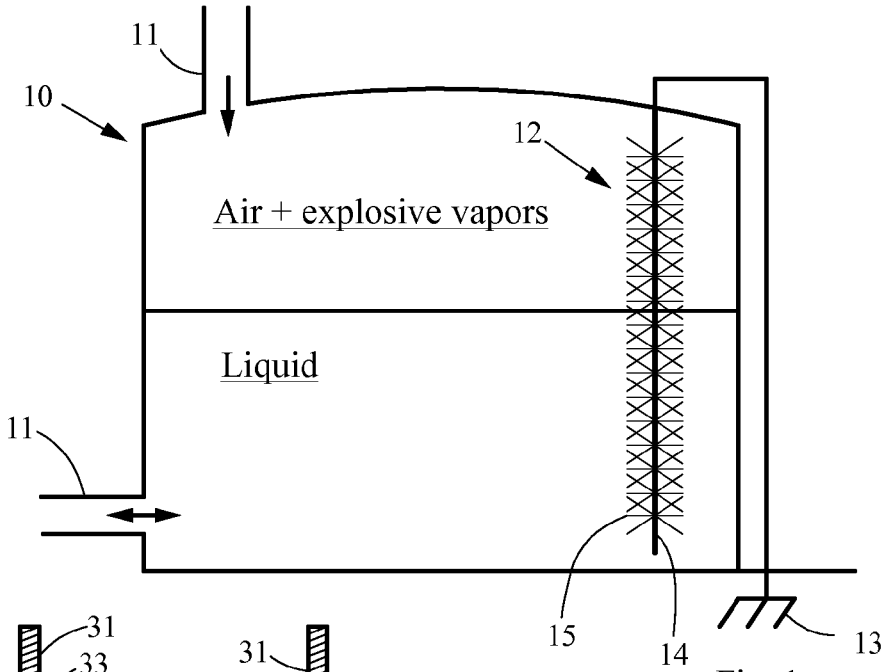
Fig. 1 Prior Art
FIG. 1 (Prior Art) shows a storage tank with a conventional stainless steel brush electrostatic charge dissipator.

The present invention provides an electrostatic charge dissipator comprising a length of electrically conductive polymeric fiber yarn with broken/cut, stray or individual fibers extending away from the yarn. The broken, stray and individual fibers have small diameters and/or sharp tips, and therefore function to concentrate electric field. The fiber yarn or yarns can comprise dozens, hundreds or thousands of individual fibers, and can be woven, braided, twisted, felted or bundled, for example. The fiber material is electrically connected to a ground potential, and suspended from a top inner surface (ceiling) or sidewall of a tank. An optional weight may be attached to a hanging end of the dissipator to hold it down. Also, an optional support (e.g. rope, chain, cable, or rigid rod) may be attached to the conductive fiber yarn and may be used to bear the load of the optional weight, so that the fiber yarn does not bear the weight load. Alternatively, a bottom end of the dissipator may be glued, bolted, hooked or otherwise attached to a bottom surface of the tank.

In a preferred embodiment, the conductive polymeric fiber yarn comprises carbon fiber. Alternatively, the conductive polymeric fiber yarn can comprise conductive polymers or plastics, such as intrinsically conductive polymers, or non-conductive polymer composites with embedded conductive particles. Conductive polymeric fibers can be used in any of the embodiments described herein.

The present charge dissipator is inherently highly corrosion resistant and low cost because the fibers are nonmetallic. Carbon fibers have small sharp features that highly concentrate electric fields and facilitate charge collection. Also, dislodged or shedding polymeric or carbon fibers will not damage downstream liquid handling equipment.

DEFINITIONS

Exposed: Lacking a nonconductive coating or covering such as a resin coating (e.g. polyester or epoxy), tubing or paint. The surface of exposed conductive fiber is electrically conductive.

Conductive polymeric fiber: Any fiber material having electrical conductivity sufficient for collecting electrostatic charge, and made of a polymeric material. Fiber diameter can be in the range of 1-1000 microns for example. Suitable conductive polymeric fiber can be made of carbon fiber, inherently conductive polymers, or polymer composites comprising a non-conductive polymeric matrix combined with conductive materials such as carbon nanotubes, carbon black, metal particles, chopped carbon fiber or the like.

Support: Any elongated material or structure that can reduce flexing or flopping of the conductive fiber yarn. A support can be rigid or flexible. A support can be made of rope, cable, wire, chain, string, elastomeric/flexible rod or solid rod or the like. The support can be made of any material including plastics, polymers, composites and metals.

Yarn: A collection of a plurality or large number of approximately parallel (over a long length scale), loosely twisted, woven or aggregated fibers. A yarn can comprise tangled fibers. A yarn will typically comprise at least about 20, 100 or 500 individual fibers. For example, carbon fiber yarns often contain 3000 or 6000 fibers.

Electrical feedthrough: Any electrically conductive material extending through a wall of the tank, between tank interior and tank exterior. The tank wall can comprise the tank ceiling, tank sidewalls, tank bottom or any other portion of the tank. The electrical feedthrough provides an electrical connection between conductive fibers comprising the present dissipator, and an electrical ground connection. An electrical feedthrough can comprise a metal bolt.

Figure 2:
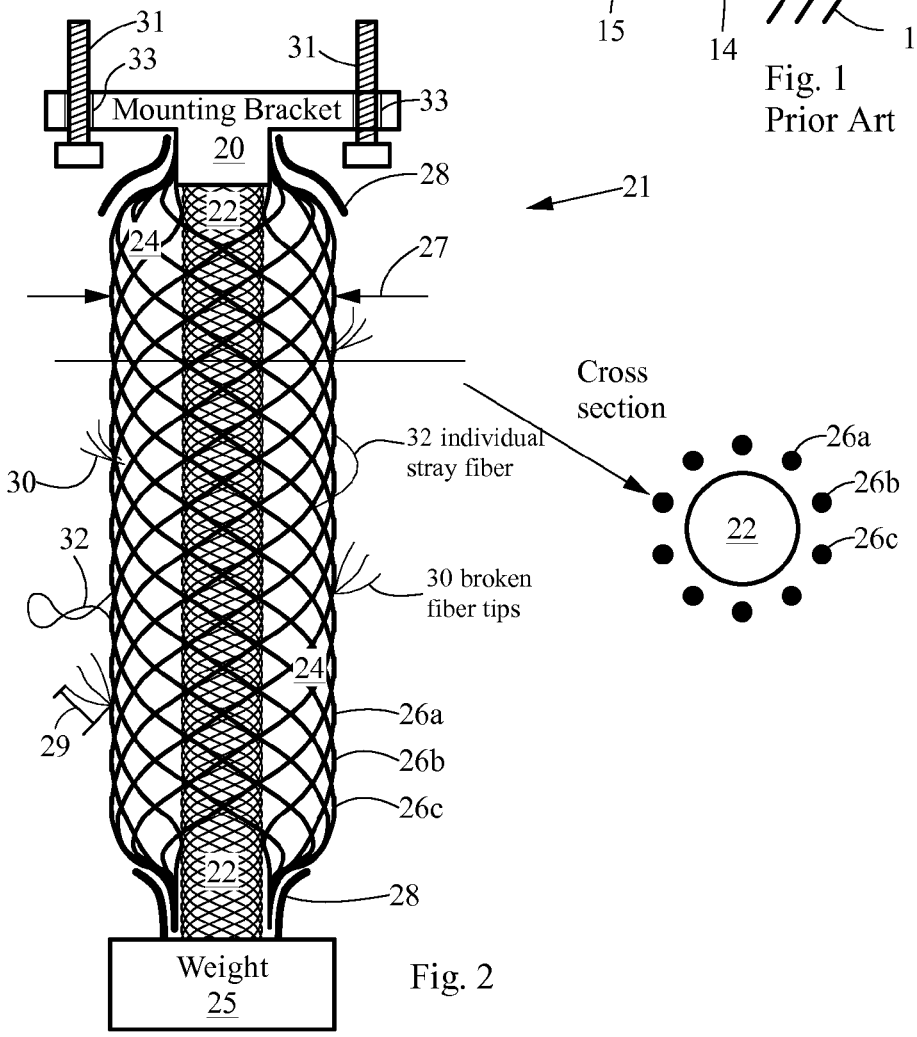
FIG. 2 shows an embodiment of the present invention comprising a rope support and a carbon fiber sleeve coaxial with the rope.

FIG. 2 shows an electrostatic charge dissipator 21 according to one embodiment of the present invention. The dissipator comprises a mounting bracket 20 for mounting to a ceiling of a storage tank (not shown), a support 22 (e.g. comprising a rope) attached to the mounting bracket 20 and a weight 25 attached to the support 22. The mounting bracket 20 and weight 25 are attached to opposite ends of the support 22. Surrounding and coaxial with the support 22 is a carbon fiber braided sleeve 24. The braided sleeve 24 comprises individual yarns 26*a* 26*b* 26*c*, as known in the art. Each yarn 26*a* 26*b* 26*c* can comprise hundreds or thousands (e.g. 3000 or 6000) of individual carbon fibers. Each individual carbon fiber can be about 5-10 microns in diameter for example.

Heat shrink tubing 28 encloses both ends of the carbon fiber sleeve 24, and thereby prevents unraveling of the carbon fiber sleeve. The heat shrink tubing 28 can have hot melt adhesive on its inner surface.

An outer diameter 27 of the carbon fiber sleeve is enlarged for clarity. In some embodiments the carbon fiber sleeve outer diameter 27 can be nearly the same as an outer diameter of the rope support 22.

FIG. 2 also shows a cross sectional view of the rope support 22 and the carbon fiber sleeve yarns 26*a* 26*b* 26*c*. The carbon fiber sleeve of the embodiment of FIG. 2 is illustrated as having 10 braided yarns, but it can have any number of yarns (e.g. 3-1000). The support 22 and carbon fiber sleeve 24 are coaxial, with the sleeve surrounding the support 22.

The carbon fiber sleeve 24 of the present invention must have a plurality of broken or cut fiber tips 30 and/or individual unbroken stray fibers 32 projecting out from the yarns 26*a* 26*b* 26*c*. The fiber tips and stray fibers are sharp due to the small diameter (5-10 microns typically) of the carbon fibers. Consequently, they tend to concentrate electric fields when an electrostatic charge is nearby. This is crucial for operation of the present dissipator because concentrated electric fields at the sharp tips 30 and stray fibers 32 facilitates charge flow to the dissipator.

Preferably, the carbon fiber sleeve 24 (including all yarns 26*a* 26*b* 26*c* etc) has at least about 10, 100, 500 or 1000 broken fiber tips and individual fibers per linear foot of the dissipator. The density of broken fiber tips and individual stray fibers can also be much higher, for example exceeding 2000, 5000 or 10000 projecting tips and stray fibers per linear foot of the dissipator. Also the density of broken fiber tips will typically be lower for embodiments having large-diameter fibers (e.g. 250-1000 microns), and higher for embodiments having small-diameter fibers (e.g. 1-20 microns).

The fiber tips 30 and stray fibers 32 preferably have a length 29 of at least about 0.010", 0.020", 0.050", 0.10" or 0.25". The distance they project away from the yarn will change with handling and movement of the dissipator, and local electric field strength. Typically with carbon fiber, the tips will not project further than about 0.50" or 1" from the yarns; however, the present invention and appended claims are not limited to any particular length of the fiber tips or stray fibers.

In the present invention, the carbon fiber sleeve 24 can be abraded (e.g. rubbed with sandpaper), partially broken, partially cut or otherwise damaged (e.g. by crushing, incising, clipping, sandblasting, laser ablation, pulling, unwinding or shearing) to increase the number of broken fiber tips 30 and/or stray fibers 32. Carbon fibers are brittle and so broken fiber tips can be formed by bending the carbon fibers to a small radius of curvature.

The carbon fibers must be at least partially bare, without a continuous coating of resin, paint or other nonconductive material or surface coating. A nonconductive resin coating will block charge transfer and cause all fibers to lay flat so that they do not project away from the yarns. An uncovered, bare conductive fiber material is described herein as "exposed". This is very different from how carbon fiber is commonly used: as part of a composite material in which the carbon fiber is embedded in an electrically-insulating resin matrix (e.g. comprising epoxy, polyester or the like). A resin matrix covering the carbon fibers is not compatible with the present invention because resin is an electrical insulator, and will block charge flow to the carbon fibers. In the present invention at least the carbon fiber tips 30 or stray fibers 32 must be exposed. However, it is within the scope of the present invention for portions of the carbon fiber sleeve to be covered with electrically insulating coating or resin matrix material, or for carbon fibers to extend outside of a resin matrix material. For example, the terminal ends of the yarns can be covered with resin material to prevent unraveling. Also, for example, one side of the carbon fiber sleeve can be covered with resin to prevent unraveling or damage. Or a thin coating of resin material can be applied that allows exposed fiber tips and stray fibers to extend outside of the resin coating.

It is noted that because the carbon fibers are thin and flexible, nearby electrostatic charge will tend to pull carbon fibers out of the yarn and straighten them. Consequently, the number of fiber tips and stray fibers projecting from the yarns will tend to increase in high electric field environments. This is a substantial advantage of the present invention, because it causes the present dissipator to become more effective when there is a large amount of electrostatic charge nearby. Accordingly, it is preferred in the present invention for the minimum number of stray fiber tips and stray fibers to exceed the minimum (at least 10 or 100 or 1000 fibers at least about 0.010" long, per foot of the dissipator) in high field environments.

The mounting bracket can have holes 33 for mounting with bolts 31. Alternatively, the mounting bracket can be attached to the tank ceiling with glue, adhesive, welds, screws, clamps or any other method. The present invention and appended claims are not limited to any particular design or material for the bracket 20, and are not limited to any method or structure for attaching the bracket 20 to a tank.

Figure 3:
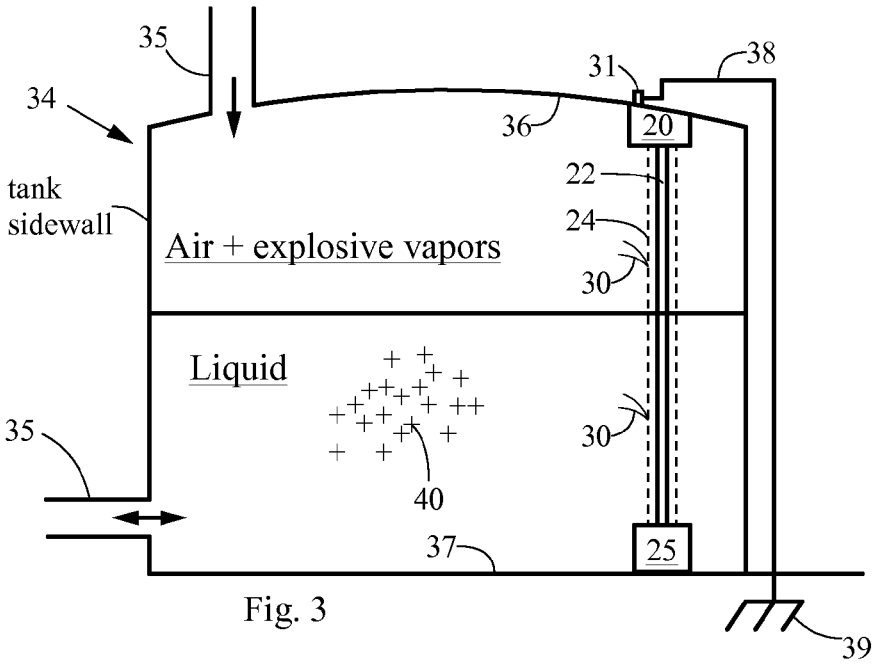
FIG. 3 shows an embodiment of the present invention installed in a storage tank.

FIG. 3 shows the present static dissipator installed inside a tank 34 susceptible to electrostatic charge accumulation. The tank 34 can be made of any material, but tanks made of electrically insulating materials, or coated with electrically insulating materials are most susceptible to electrostatic charge buildup. In typical applications, the tank can be made of plastic (e.g. polyethylene), fiberglass-polyester composite, carbon fiber-epoxy composite or epoxy-coated or painted steel. The tank 34 has pipes 35 through which liquids enter and exit the tank 34.

The bracket 20 is attached to a ceiling 36 of the tank with bolts 31. The support 22 is preferably long enough such that the weight 25 is closer to a bottom 37 of the tank than to the ceiling 36. In some embodiments, the weight 25 may rest on the bottom of the tank, such that the support 22 does not bear the full load of the weight. In some embodiments, the carbon fiber 24 and support 22 bear little or no load of the weight 25. The weight may simply rest on the bottom of the tank 37.

An electrical ground conductor 38 provides an electrical connection to ground potential 39. The ground potential 39 is electrically connected to the carbon fiber sleeve 24 via the bolts 31. Optionally, the bracket 20 is electrically connected in series with the conductor 38 and carbon fiber sleeve 24. Alternatively, if the bracket 20 is an electrical insulator, the carbon fiber sleeve is electrically connected to the bolt 31 that attaches the bracket 20 to the ceiling 36. In other words, the bolts 31 can function as an electrical feedthrough, providing an electrical connection between the electrical conductor 38 and the bracket 20 and fiber sleeve 24.

In operation, electrostatic charge 40 in the liquid or air portion of the tank is collected by the broken fiber tips 30 and stray fibers 32 extending from the carbon fiber sleeve 24. The present dissipator will collect charge from both the liquid and gas portions. Charge then flows through the carbon fiber sleeve 24, through the bolt 31 to the ground potential 39. The electrostatic charge may come into contact with the carbon fiber sleeve 24 as the liquid or air circulates inside the tank. Also, the electrostatic charge will be attracted to the carbon fiber sleeve and flow toward the sleeve 24 due to electrostatic forces, as known in the art. When electrostatic charges are eliminated from the tank, the risk of an electrostatic-spark triggered explosion is greatly reduced.

The mounting bracket 20 can comprise many different materials. The mounting bracket 20 can be made of bronze, steel, stainless steel, plastic-coated metal, plastics, lead-coated steel, composites, fiberglass, static-dissipating plastics, galvanized steel, or other materials. If the mounting bracket is made of metal or other conductive material, then it can function as part of an electrical path to ground potential (i.e. connected in series between the carbon fiber sleeve 24 and ground conductor 38).

The support 22 can be attached to the bracket 20 and weight 25 by tied knots, adhesive, crimping, braiding, clamps or any other method or device. The present invention and appended claims are not limited to any particular method for attaching the support 22 to the bracket 20 or weight 25.

The support 22 can comprise many different materials and structures suitable for preventing flopping of the carbon fiber, preventing excessive strain on the carbon fiber, or bearing the load of the weight 25. The support 22 can be electrically conductive or nonconductive. The support can comprise braided rope as illustrated in FIG. 2 or any other type of rope suitable for the chemical exposures to be expected in the tank. The rope can be made of polyethylene, polyester, nylon or polypropylene for example. The rope can comprise many fibers or can be monofilament, and can be twisted or braided.

The support can be made of many other materials, such as chain (plastic or metal), cable, cord, metal wire, solid plastic, elastomeric (e.g. rubber) or metal rod or the like. Plastic materials are generally preferred for many applications because they are inexpensive and often resistant to chemicals and corrosion. Polymeric materials are generally resistant to the corrosive materials present in petroleum drilling and process tanks (hydrogen sulphide, chlorides, hydrochloric acid, salts for example). Also, the support 22 can comprise metal wire rope, though this may be undesirable for some applications because of corrosion. The metal wire rope can be plastic-coated to reduce corrosion.

The support 22 can also comprise plastic or epoxy coated metal chain or a solid rod of material, such as a plastic, fiberglass or solid metal rod. The rod can be rigid, or flexible. In the case of a rigid rod particular care should be taken to avoid concentrating strain at the point of attachments with the mounting bracket 20 or weight 25.

The present invention and appended claims are not limited to any particular design or material for the support 22.

The support 22 can be any suitable length for the particular application. The length of the support 22 and conductive fibers will generally depend on the dimensions of the tank 34. In many applications inside tanks used in petroleum storage tanks, or production or disposal tanks, lengths of about 3-30 or 5-50 feet are typical.

FIG. 3 shows a vertical installation of the present dissipator. However, the present dissipator can also be installed horizontally or at a slanted angle. With a horizontal installation, brackets may be provided at both ends of the dissipator, for attachment to opposite tank sidewalls.

The weight 25 can be for example about 1-75 pounds, or more typically about 10-30 pounds. The weight 25 functions to hold the dissipator down, and prevent it from swinging and flopping wildly inside the tank. When fluid is flowing into or out of a tank, violent splashing and sloshing of the liquid can occur. Without the weight, or with a weight that is too small, this splashing could cause the dissipator to become entangled, or snared on components, joints, level gauges or sensors inside the tank. This can cause damage to the dissipator (e.g. separating the support 22 and the mounting bracket 20), or damage to the tank or sensors inside the tank. For many applications in tanks of about 300-500 barrels, a weight of about 10-30 pounds is suitable. The necessary amount of weight will depend on the amount of splashing expected inside the tank, the proximity of delicate components or sensors, the length of the dissipator and the width of the support 22 or fiber sleeve 24.

Preferably, the weight 25 comprises a relatively dense inexpensive material, such as steel, cast iron, solid metal, lead, concrete, rocks, porcelain, sand or the like. The weight 25 can have a corrosion-resistant coating such as plastic, epoxy or paint for example in cases where made of a metal susceptible to corrosion (e.g. cast iron). The weight can comprise a granular or particulate material disposed inside a container (e.g. sand inside a plastic bottle). The present invention and appended claims are not limited to any particular design or material for the weight 25. Also, the present invention and appended claims are not limited to having a weight 25. The weight 25 is optional in the present invention.

Figure 4A:
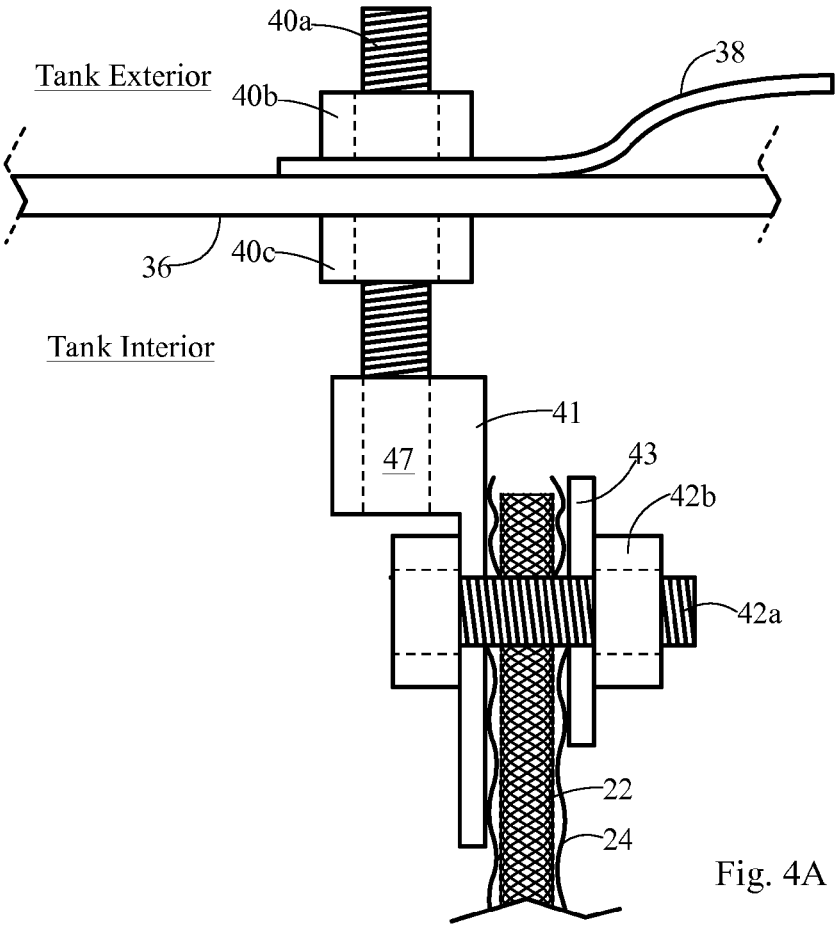
FIG. 4A shows a closeup side view of a specific bracket for attaching to a tank ceiling.

FIG. 4A shows a specific bracket mechanism suitable for use in attaching the present dissipator to a ceiling 36 (or sidewall) of the tank. The bracket has a feedthrough bolt 40*a* and nut 40*b* extending through a hole in the tank ceiling 36. The nut 40*b* and nut 40*c* clamp the ground conductor 38, which is electrically connected to the feedthrough bolt 40*a*. The feedthrough bolt 40*a* is threaded into a female threaded hole 47. The feedthrough bolt 40*a* and vertical plate 41 can also be attached by crimping, brazing, welding or any other means. The feedthrough bolt 40*a* functions as an electrical feedthrough, providing a conductive path between the tank interior and tank exterior (i.e. between conductor 38 and fiber sleeve 24). A horizontal bolt 42*a* and nut 42*b* extend through a clamping plate 43. The horizontal nut 42*b* is tightened to clamp the rope support 22 and carbon fiber sleeve 24. The clamping pressure assures a good electrical connection between the fiber sleeve 24 and vertical plate 41. The rope 22 and carbon fiber sleeve 24 may be wrapped around the horizontal bolt 42*a*. The bolts 40*a* 42*a*, nuts 40*b* 42*b* 40*c*, plate 41, and clamping plate 43 can all be made of metal such as stainless steel. The bracket of FIG. 4 provides a reliable electrical connection between the carbon fiber sleeve 24 and the ground connector wire 38, and provides a secure mechanical attachment to the tank ceiling 36. Alternatively, the bracket of FIG. 4 can be attached to the tank sidewall.

Figure 4B:
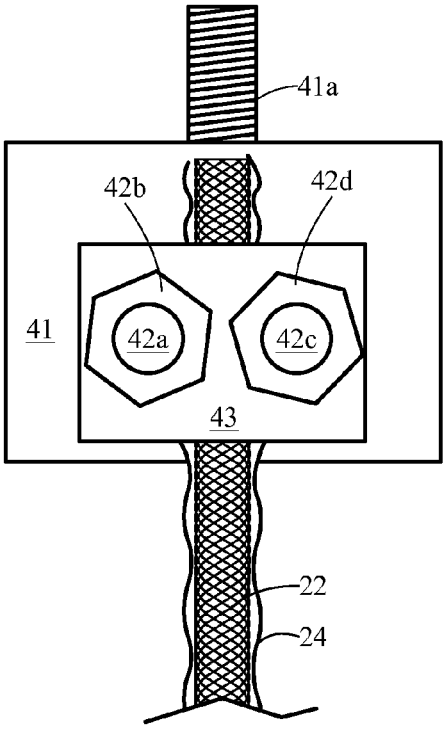
FIG. 4B shows a front view of the bracket illustrated in FIG. 4A.

FIG. 4B shows a front view (i.e. facing the vertical plate 41 and clamping plate 43) of an embodiment having two horizontal bolts 42*a* 42*c* and two horizontal nuts 42*b* 42*d*.

The rope support 22 and fiber sleeve 24 are disposed between the horizontal bolts 42*a* 42*c*.

Figure 4C:
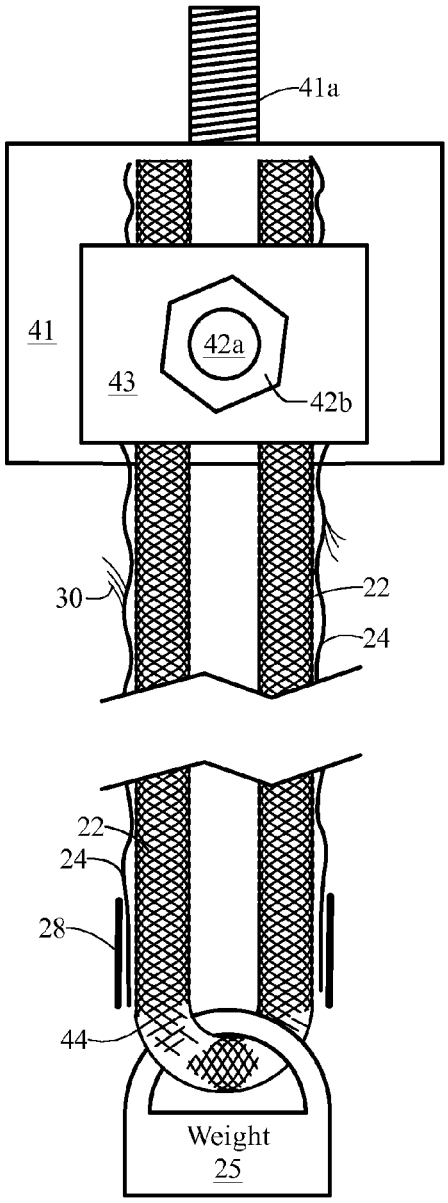
FIG. 4C shows an embodiment in which the rope support is folded at the bottom, forming a loop.

FIG. 4C shows a front view of an embodiment in which the rope support 22 is folded at the bottom, forming a loop 44. The weight 25 is interlinked with the loop 44. The braided sleeve 24 encloses both parallel portions of the rope support 22. Terminal ends of the rope support are clamped by horizontal bolt 42*a* and clamping plate 43.

Figure 5:
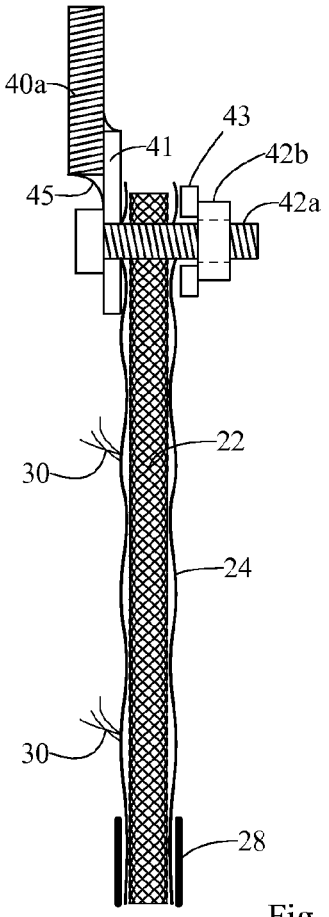
FIG. 5 shows an embodiment of the present invention that does not have a weight.

FIG. 5 shows another embodiment of the present invention that does not have a weight. The support 22 comprises a rope. The rope support 22 can be about 0.125-2" in diameter for example, and can be made of many polymeric materials such as polypropylene, nylon, polyester, or aramid fiber. The rope support 22 preferably is stiff and heavy enough to resist flopping around inside the tank. Larger diameters may be preferred for higher stiffness and greater weight. Heat shrink tubing 28 secures the carbon fiber sleeve 24 onto the support 22 and prevents fraying or unraveling of the fiber sleeve 24.

In the embodiment of FIG. 5, the feedthrough bolt 40*a* and vertical plate 41 are attached by weld 45.

Figure 6:
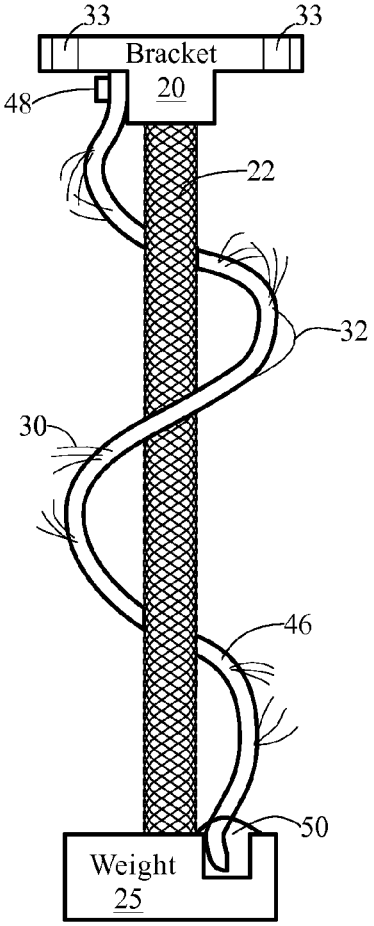
FIG. 6 shows an embodiment of the present invention comprising a single yarn.

FIG. 6 shows an embodiment having a single carbon fiber yarn 46 loosely wrapped around the support 22 and attached to the weight 25. The yarn 46 can comprise hundreds or thousands (e.g. 1000, 3000, 6000 or 10000) of individual carbon fibers. The fibers comprising the yarn can be unconnected to one another, or can be tangled, twisted, or spun together for example. The yarn 46 can be similar or identical to an individual one of the yarns 26*a* 26*b* 26*c* comprising the woven fiber sleeve 24 of FIG. 2. The embodiment of FIG. 6 also has a bolt 48 for attaching/clamping the yarn 46 to the bracket 20. The yarn 46 is optionally attached to the weight with a potting material 50 (e.g. comprising silicone rubber, epoxy, polyester resin or the like). The potting material prevents fraying of the end of the yarn 46 and keeps the yarn 46 attached. Alternatively, the potting material 50 can be replaced with a bolt, knot, heat shrink tubing, cable tie or any other device for attaching the yarn end to the weight 25 or support 22 and preventing fraying.

The yarn 46 of FIG. 6 can be replaced with a braided sleeve that is wrapped around the support just like the yarn 46.

Figure 7:
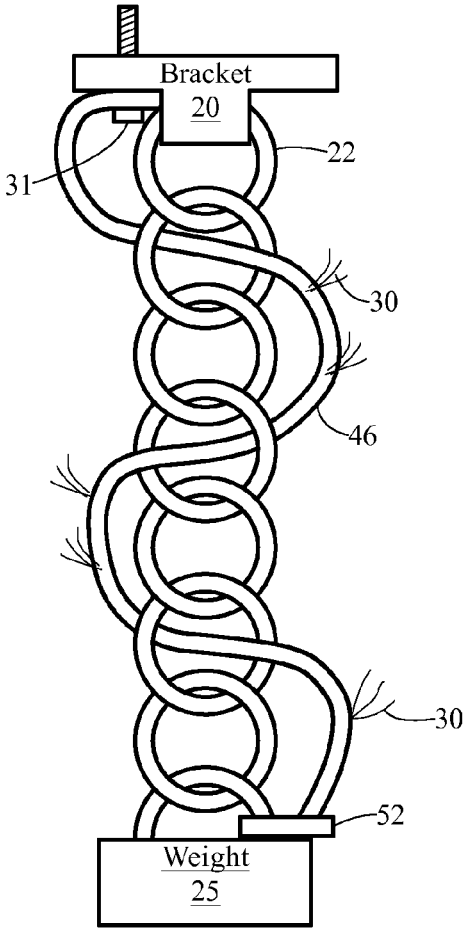
FIG. 7 shows an embodiment of the present invention in which the support comprises a chain.

FIG. 7 shows an embodiment in which the support 22 comprises a chain. The carbon fiber yarn 46 is threaded through the chain, and this serves to attach the yarn 46 to the chain support 22. The yarn 46 is attached to the chain support 22 at the bottom with a clamp or cable tie 52. The chain can be metal, plastic or other material. In the case of a metal chain, it can be plastic-coated to inhibit corrosion.

Figure 8:
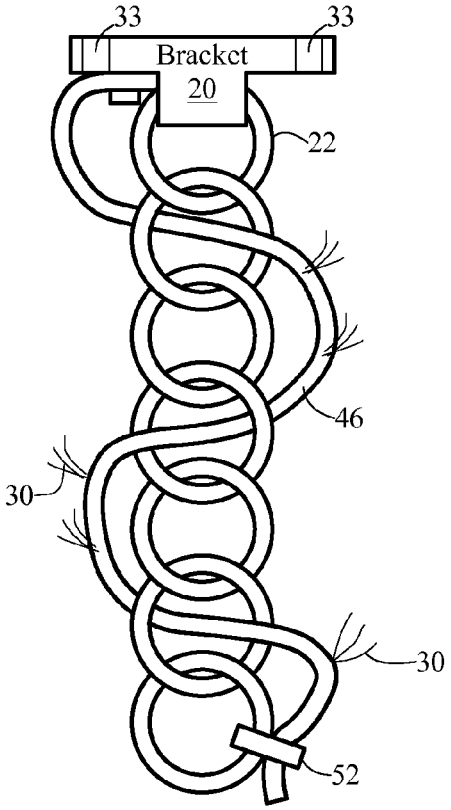
FIG. 8 shows an embodiment of the present invention that has a chain support and does not have a weight.

FIG. 8 shows an embodiment in which a weight is not present and the support 22 comprises a chain. A cable tie or clamp 52 is used to attach the bottom end of the yarn 46 to the chain, and prevent excessive fraying/unraveling of the yarn 46.

Figure 9:
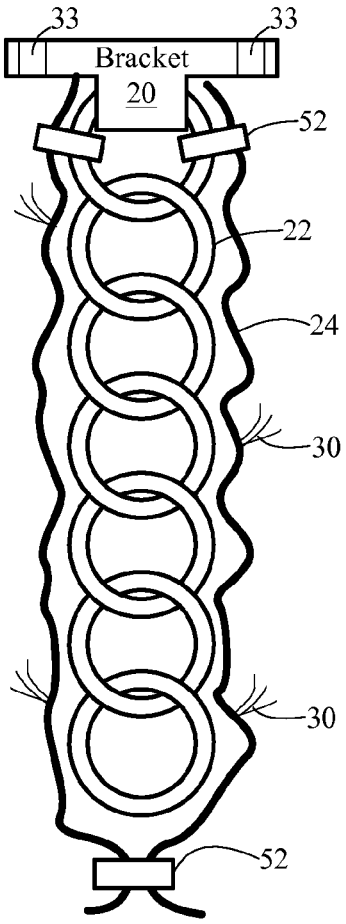
FIG. 9 shows an embodiment of the present invention comprising a chain disposed inside a fiber sleeve.

FIG. 9 shows an embodiment in which the carbon fiber sleeve 24 is disposed over and encloses the chain support 22. The sleeve 24 is secured at top and bottom with clamps or cable ties 52.

Figure 10:
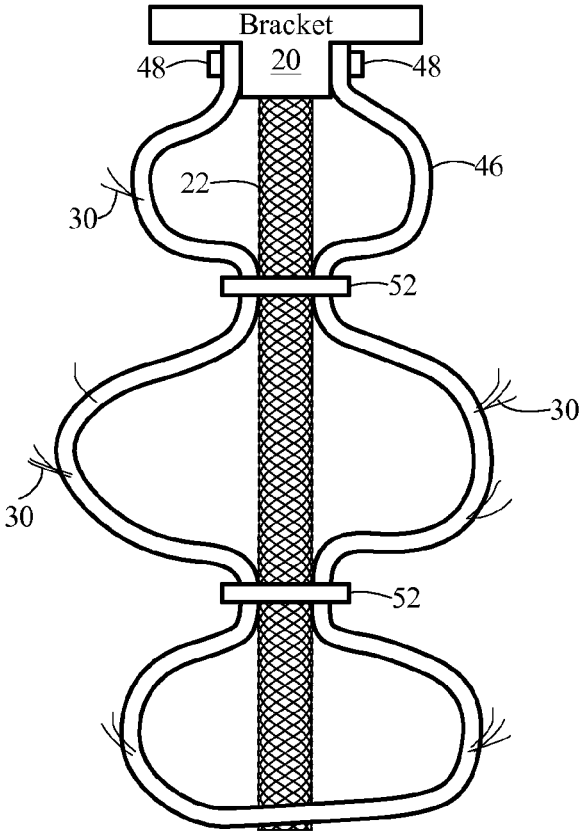
FIG. 10 shows an embodiment of the present invention comprising a yarn of conductive fibers clamped to a rope support.

FIG. 10 shows an embodiment having a yarn 46 with both ends attached to the bracket with bolts 48. Clamps or cable ties 52 attach the yarn 46 to the rope support 22.

Figure 11:
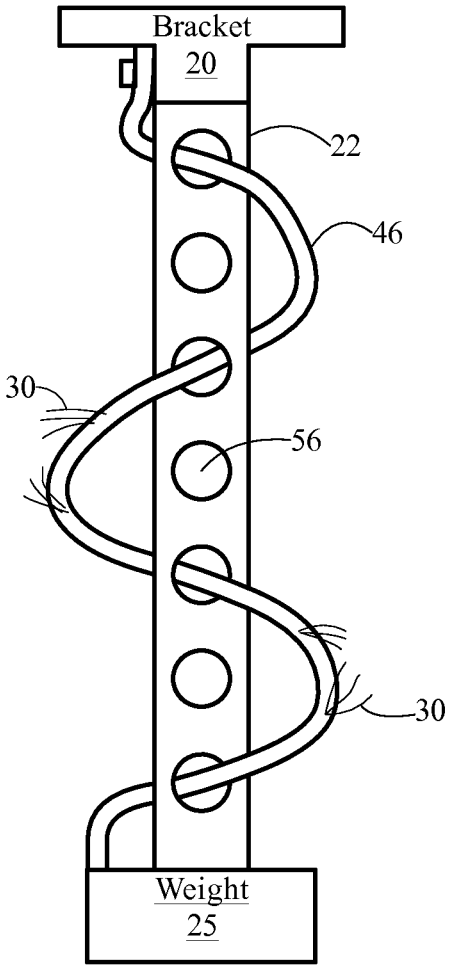
FIG. 11 shows an embodiment of the present invention in which the support comprises a strip with holes.

FIG. 11 shows an embodiment in which the support 22 is a strip of material with holes 56. The carbon fiber yarn 46 is threaded through the holes. The strip support 22 can be made of plastics such as polyethylene, polypropylene, nylon, polyvinylchloride or the like.

It is noted that the yarn 46 in the embodiments of FIGS. 7, 8, 10, and 11 can be replaced with a braided sleeve, woven carbon fiber strip or any other elongated carbon fiber or conductive fiber material or fabric. For example, the braided sleeve can be threaded through the chain or holes 56 just like the yarn 46.

Figure 12:
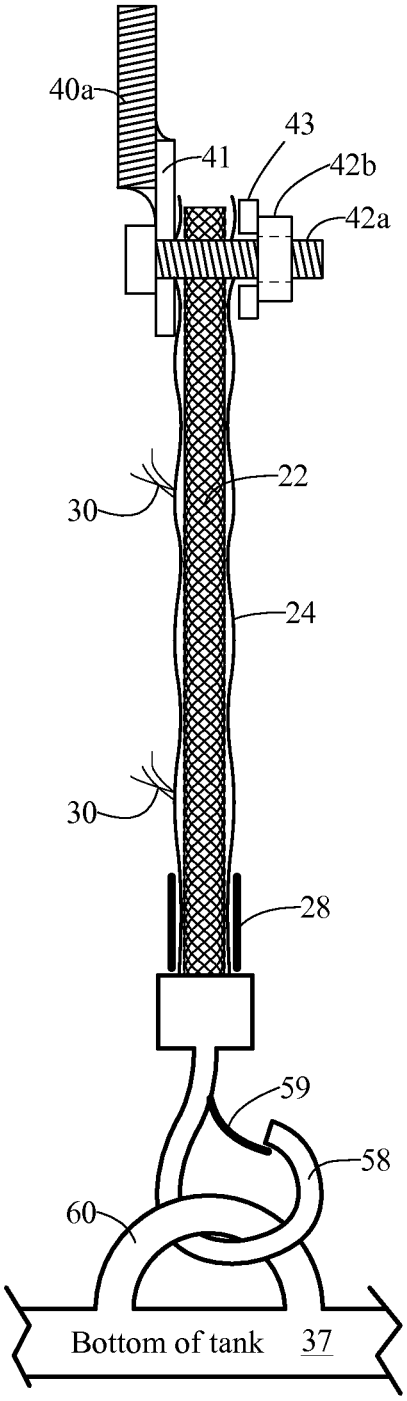
FIG. 12 shows an embodiment of the present invention in which a free end of the dissipator is removable attachable to a bottom of the tank.

FIG. 12 shows an embodiment in which a bottom end of the support 22 is connected to a hook 58 with latch 59 for attachment to a loop 60 at the tank bottom 37. The connection to the tank bottom 37 prevents the dissipator device from flopping around and potentially damaging the tank or devices inside the tank.

Figure 13:
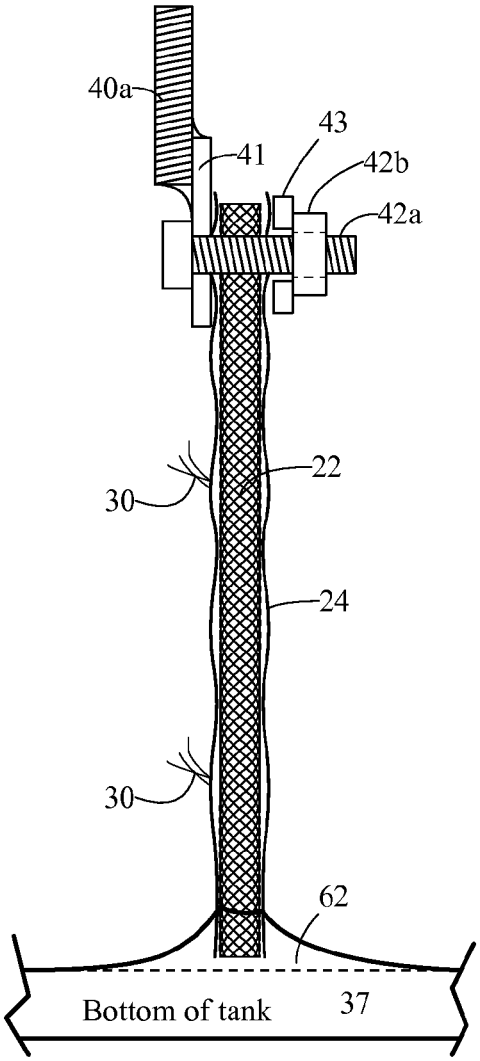
FIG. 13 shows an embodiment of the present invention in which a free end of the dissipator is bonded to a bottom of the tank.

FIG. 13 shows an embodiment in which the bottom end of the support 22 and fiber sleeve 24 are permanently bonded to the tank bottom 37. The support 22 and sleeve 24 can be bonded to the tank bottom 37 with the same material comprising the tank. For example, if the tank is made of polyester-fiberglass composite, then the bonding material 62 adhered to the dissipator can also be made with polyester-fiberglass.

Figure 14:
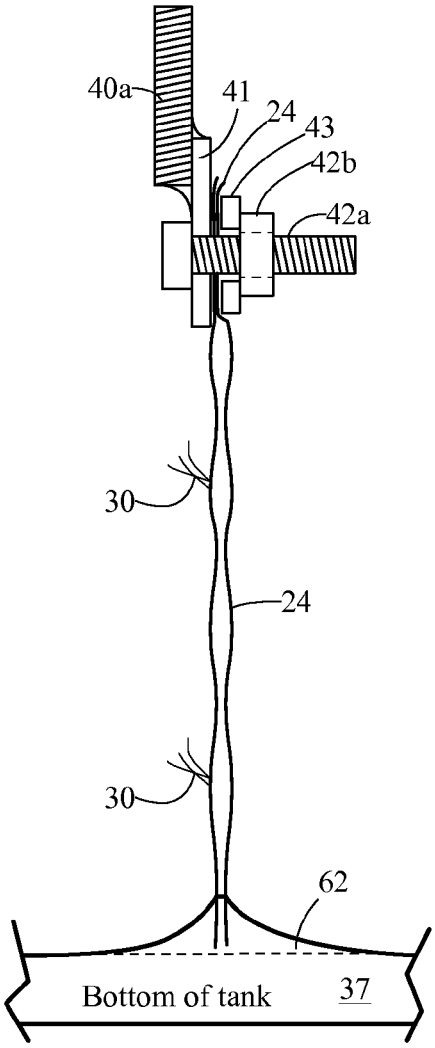
FIG. 14 shows an embodiment of the present invention that does not have a support, and in which the braided sleeve is bonded to the bottom of the tank.

FIG. 14 shows an embodiment in which the support is absent and only the fiber sleeve 24 is bonded to the tank bottom 37.

Figure 15:
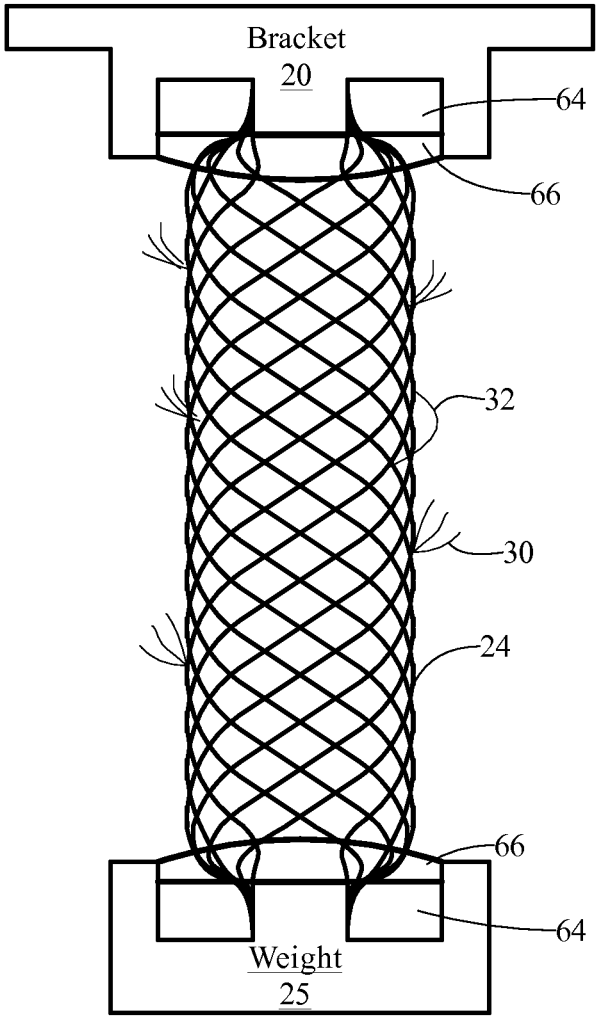
FIG. 15 shows an embodiment of the present invention that does not have a support, and in which the braided sleeve is bonded to the weight.

FIG. 15 shows an embodiment that does not have a support 22. The conductive fiber sleeve 24 is attached to the bracket 20 and weight 25 with adhesive. A first rigid adhesive 64 (e.g. epoxy or polyester resin) attaches the fiber sleeve 24 to the bracket 20 and weight 25. A softer, resilient material 66 (e.g. comprising silicone rubber or urethane) provides strain relief for the fiber sleeve 24. Without the resilient material 66, the fiber sleeve 24 may experience small-radius bending at the surface of the rigid adhesive 64, causing breakage of the fibers. Alternatively, only a single potting material is present that provides both strong attachment and strain relief (e.g. urethane adhesives).

Figure 16:
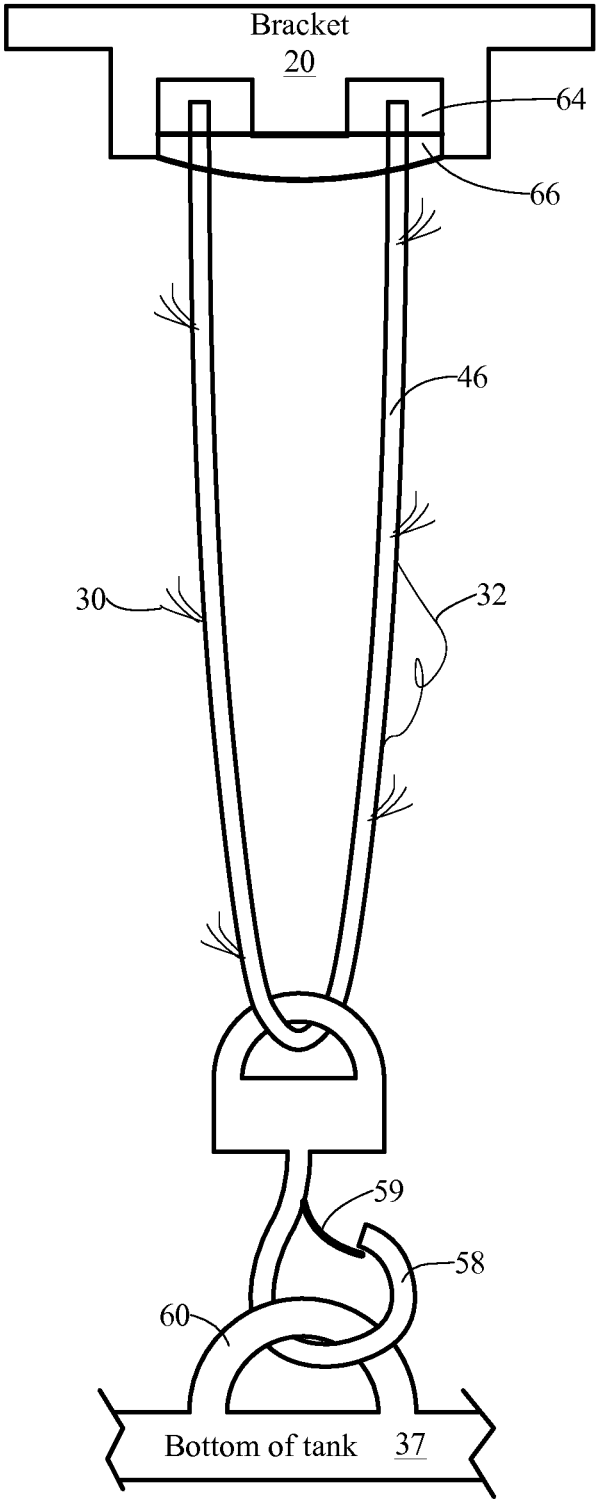
FIG. 16 shows an embodiment of the present invention having a conductive fiber yarn with both terminal ends bonded to the bracket, and a hook/latch mechanism interlinked at a bottom of the yarn.

FIG. 16 shows another embodiment having a yarn 46 with both terminal ends attached to the mounting bracket 20. The hook 58 is suspended from the yarn 46, and the hook 58 attaches to the loop 60 at the tank bottom 37.

Figure 17:
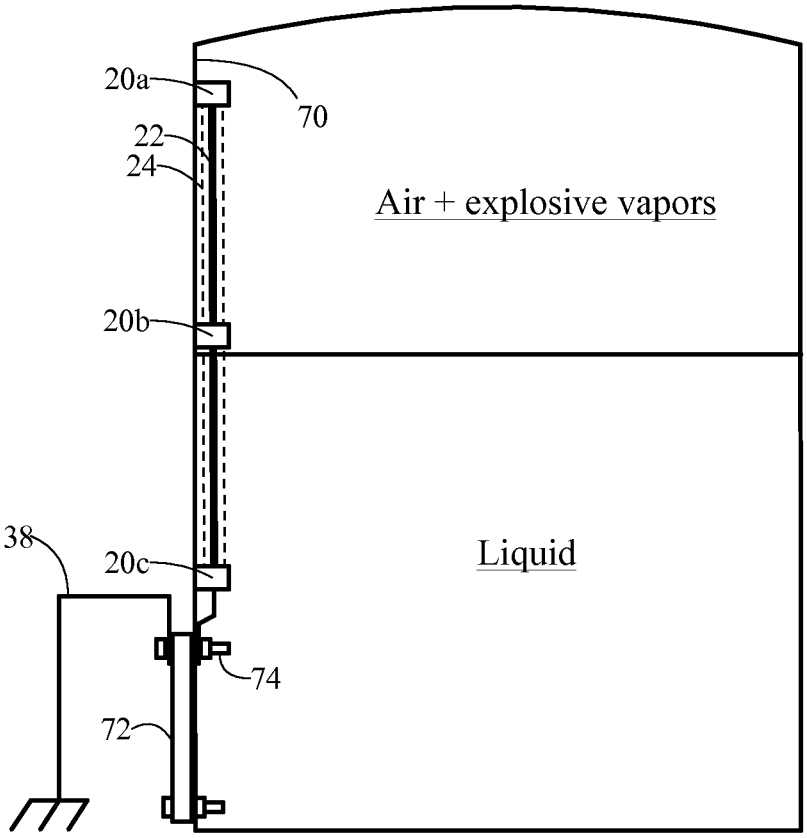
FIG. 17 shows an alternative method for installing the dissipator of the present invention.

FIG. 17 shows an alternative arrangement for installation of the present electrostatic dissipator. The dissipator is attached to an interior sidewall 70 of the tank 34 with multiple brackets 20*a* 20*b* 20*c*. The dissipator of FIG. 17 is hanging from brackets 20*a* 20*b* 20*c*. The tank 34 comprises a hatch or other opening 72 attached to the tank with bolt 74. Bolt 74 functions as an electrical feedthrough, providing an electrical connection between the fiber sleeve 24 and ground connection 38.

Figure 18:
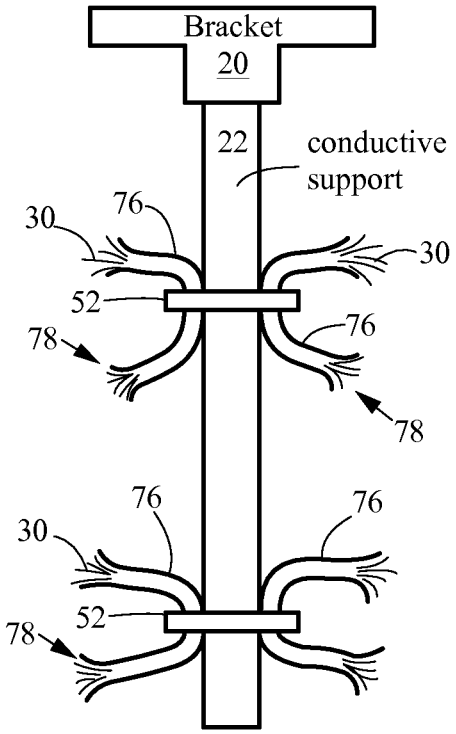
FIG. 18 shows an embodiment of the present invention having yarn segments attached to an electrically conductive support.

FIG. 18 shows another embodiment of the invention in which short yarn segments 76 are attached to the support 22, and the support 22 is electrically conductive. The conductive support can comprise metal or conductive polymers or carbon fiber or plastics for example. The yarn segments 76 have cut ends 78 with fiber tips 30. The fiber tips 30 are created by cutting the yarn segments 76. The yarn segments 76 are attached to the conductive support 22 with clamps or cable ties 52. In the embodiment of FIG. 18, the yarn segments 46 are mechanically attached to the bracket 20 even though they are not in direct contact with the bracket 20.

In embodiments where non-carbon fiber yarns are used, the fibers can comprise many different types of conductive or static-dissipative plastics or polymers. The plastics or polymers used can be intrinsically conducting (e.g. polyaniline, polypyrrole, polyacetylene) or can be conductive due to embedded conductive fibers, particles, carbon or nanowires (i.e. known as "conductive polymer composites"). Such conductive plastics and polymers are known in the art. Examples of plastics and polymers suitable for use include composites based on polypropylene, polyethylene, and nylon.

Conductive polymer composites can be made by incorporating many types of conductive particles, such as carbon black, carbon nanotubes, chopped carbon fiber, graphite powder, metal particles (e.g. aluminum powder), or metal fibers. These conductive materials can be incorporated into many different types of plastics or polymers that can be extruded or spun into fibers suitable for use in the present invention.

The conductive fiber yarns used in the present dissipator can have a wide range of electrical resistance values, for example in the range of 0.1 to $1\times10^9$ ohms or $1\times10^3$ to $1\times10^6$ ohms per linear foot of dissipator. Embodiments using carbon fiber will generally have a low resistance of less than 100 ohms. In one specific embodiment having a carbon fiber sleeve about 1 inch diameter, the dissipator has a resistance for low voltages of about 0.5-5 ohms per foot. Dissipators comprising conductive plastic fibers will typically have higher resistance values, depending on the specific material, and the amount of conductive material embedded in the plastic fibers. The optimal electrical resistance will depend on several factors: the desired relaxation time for removing electrostatic charges in the tank, the rate of charge accumulation in the tank, and the maximum tolerable amount of charge in the tank.

The above embodiments may be altered in many ways without departing from the scope of the invention. Accordingly, the scope of the invention should be determined by the following claims and their legal equivalents.

What is claimed is:

1. An electrostatic charge dissipator for collecting and removing electrostatic charge from inside a tank, comprising:

a) a mounting bracket for attachment to an interior of the tank;

b) an electrical feedthrough for providing an electrical conduction path between tank interior and tank exterior;

c) at least one electrically-conductive polymeric fiber yarn electrically connected to the feedthrough and mechanically attached to the bracket, wherein the at least one conductive fiber yarn is exposed and has, in aggregate, at least 10 broken fiber tips or stray fibers per linear foot of the dissipator projecting from the at least one conductive fiber yarn.

2. The dissipator of claim 1 wherein the conductive fiber yarn comprises carbon fiber.

3. The dissipator of claim 1 wherein the conductive fiber yarn comprises a nonconductive polymeric material containing conductive particles, conductive fibers, or conductive nanowires.

4. The dissipator of claim 1 further comprising a support with a first end attached to the bracket, and a second end.

5. The dissipator of claim 4 wherein the conductive fiber yarns are in the form of a braided sleeve surrounding the support.

6. The dissipator of claim 4 wherein the support comprises a rope, chain, cable, rigid rod, wire or strip with holes.

7. The dissipator of claim 4 further comprising a weight attached to the second end of the support.

8. The dissipator of claim 4 wherein the second end of the support is attached to a bottom of the tank.

9. The dissipator of claim 4 wherein the conductive fiber yarns are wrapped around or threaded through the support.

10. The dissipator of claim 1 wherein the mounting bracket comprises a feedthrough bolt attached to a plate, and wherein the conductive fiber yarns are clamped against the plate.

11. The dissipator of claim 1 wherein the conductive fiber yarns have, in aggregate, at least 100 broken fiber tips or stray fibers per linear foot projecting from the yarns.

12. The dissipator of claim 1 wherein the conductive fiber yarns have, in aggregate, at least 500 broken fiber tips or stray fibers per linear foot projecting from the yarns.

13. The dissipator of claim 1 wherein the broken fiber tips and stray fibers project at least about 0.020" from the yarns.

14. The dissipator of claim 1 further comprising a weight attached to the fiber yarn, on an end of the fiber yarn opposite from the bracket.

15. A liquid storage tank, comprising:

a) an electrically non-conductive interior surface;

b) tank walls enclosing an interior volume;

c) a bracket attached to the tank, inside the tank;

d) an electrical feedthrough for providing an electrical conduction path between tank interior and tank exterior;

e) at least one electrically-conductive polymeric fiber yarn electrically connected to the feedthrough and mechanically attached to the bracket and hanging from the bracket inside the tank, wherein the at least one conductive fiber yarn is exposed and has at least 10 broken fiber tips or stray fibers per linear foot of the dissipator projecting from the at least one conductive fiber yarn.

16. The liquid storage tank of claim 15 wherein the conductive fiber yarn comprises carbon fiber.

17. The liquid storage tank of claim 15 wherein the conductive fiber yarn comprises a nonconductive polymeric material containing conductive particles, conductive fibers, or conductive nanowires.

18. The liquid storage tank of claim 15 further comprising a support with a first end attached to the bracket, and a second end.

19. The liquid storage tank of claim 18 wherein the conductive fiber yarns are in the form of a braided sleeve surrounding the support.

20. The liquid storage tank of claim 18 wherein the support comprises a rope, chain, cable, rigid rod, wire or strip with holes.

21. The liquid storage tank of claim 18 further comprising a weight attached to the second end of the support.

22. The liquid storage tank of claim 18 wherein the second end of the support is attached to a bottom of the tank.

23. The liquid storage tank of claim 18 wherein the conductive fiber yarns are wrapped around or threaded through the support.

24. The liquid storage tank of claim 15 wherein the mounting bracket comprises a feedthrough bolt attached to a plate, and wherein the conductive fiber yarns are clamped against the plate.

25. The liquid storage tank of claim 15 wherein the conductive fiber yarns have, in aggregate, at least 100 broken fiber tips or stray fibers per linear foot projecting from the yarns.

26. The liquid storage tank of claim 15 wherein the conductive fiber yarns have, in aggregate, at least 500 broken fiber tips or stray fibers per linear foot projecting from the yarns.

27. The liquid storage tank of claim 15 wherein the broken fiber tips and stray fibers project at least about 0.020" from the yarns.

28. The liquid storage tank of claim 15 further comprising a weight attached to the fiber yarn, on an end of the fiber yarn opposite from the bracket.

29. A liquid storage tank, comprising:

a) an electrically non-conductive interior surface;

b) tank walls enclosing an interior volume;

c) an electrical feedthrough for providing an electrical conduction path between tank interior and tank exterior;

d) at least one electrically-conductive polymeric fiber yarn electrically connected to the feedthrough and hanging inside the tank, wherein the at least one conductive fiber yarn is exposed and has at least 10 broken fiber tips or stray fibers per linear foot of the dissipator projecting from the at least one conductive fiber yarn.

30. The liquid storage tank of claim 29 wherein the conductive fiber yarn comprises carbon fiber.

31. The liquid storage tank of claim 29 wherein the conductive fiber yarn comprises a nonconductive polymeric material containing conductive particles, conductive fibers, or conductive nanowires.

32. The liquid storage tank of claim 29 further comprising a support with a first end attached to the tank, and a second end.

33. The liquid storage tank of claim 32 wherein the conductive fiber yarns are in the form of a braided sleeve surrounding the support.

34. The liquid storage tank of claim 32 wherein the support comprises a rope, chain, cable, rigid rod, wire or strip with holes.

35. The liquid storage tank of claim 32 further comprising a weight attached to the second end of the support.

36. The liquid storage tank of claim 32 wherein the second end of the support is attached to a bottom of the tank.

37. The liquid storage tank of claim 32 wherein the conductive fiber yarns are wrapped around or threaded through the support.

38. The liquid storage tank of claim 29 wherein the conductive fiber yarns have, in aggregate, at least 100 broken fiber tips or stray fibers per linear foot projecting from the yarns.

39. The liquid storage tank of claim 29 wherein the conductive fiber yarns have, in aggregate, at least 500 broken fiber tips or stray fibers per linear foot projecting from the yarns.

40. The liquid storage tank of claim 29 wherein the broken fiber tips and stray fiber project at least about 0.020" from the yarns.

41. The liquid storage tank of claim 29 wherein a hanging end of the fiber yarn is attached to a bottom of the tank.

42. An electrostatic charge dissipator for collecting and removing electrostatic charge from inside a tank, comprising:

a) a mounting bracket for attachment to the tank inside the tank;

b) a support with a first end attached to the bracket, and a second end;

c) an electrical feedthrough for providing an electrical conduction path between tank interior and tank exterior;

d) a braided sleeve comprising electrically-conductive polymeric fiber yarns electrically connected to the feedthrough, wherein the braided sleeve surrounds the support and is exposed and has at least 10 broken fiber tips or stray fibers per linear foot of the dissipator projecting from the braided sleeve.

43. The dissipator of claim 42 wherein the braided sleeve comprises carbon fiber.

44. The dissipator of claim 42 wherein the conductive fiber yarns comprises a nonconductive polymeric material containing conductive particles, conductive fibers, or conductive nanowires.

45. The dissipator of claim 42 wherein the support comprises a rope, chain, cable, rigid rod, wire or strip with holes.

46. The dissipator of claim 42 further comprising a weight attached to the second end of the support.

47. The dissipator of claim 42 wherein the second end of the support is attached to a bottom of the tank.

48. The dissipator of claim 42 wherein the mounting bracket comprises a feedthrough bolt attached to a plate, and wherein the conductive fiber yarns and support are clamped against the plate.

49. The dissipator of claim 42 wherein the conductive fiber yarns have, in aggregate, at least 100 broken fiber tips or stray fibers per linear foot projecting from the yarns.

50. The dissipator of claim 42 wherein the broken fiber tips and stray fibers project at least about 0.020" from the yarns.

51. An electrostatic charge dissipator for collecting and removing electrostatic charge from inside a tank, comprising:

a) a mounting bracket for attachment to the tank inside the tank;

b) a support with a first end attached to the bracket, and a second end;

c) an electrical feedthrough for providing an electrical conduction path between tank interior and tank exterior;

d) a braided sleeve comprising carbon fibers electrically connected to the feedthrough, wherein the braided sleeve surrounds the support and is exposed and has at least 200 broken carbon fiber tips or stray fibers per linear foot of the dissipator projecting from the braided sleeve by at least 0.020 inches.

52. The dissipator of claim 51 wherein the support comprises a rope, chain, cable, rigid rod, wire or strip with holes.

53. The dissipator of claim 51 further comprising a weight attached to the second end of the support.

54. The dissipator of claim 51 wherein the carbon fibers have, in aggregate, at least 500 broken fiber tips or stray fibers per linear foot projecting from the yarns.

* * * * *